US009902603B2

(12) United States Patent
Clüsserath et al.

(10) Patent No.: US 9,902,603 B2
(45) Date of Patent: Feb. 27, 2018

(54) METHOD AND FILLING MACHINE FOR FILLING CANS OR THE LIKE CONTAINERS WITH LIQUID CONTENTS

(71) Applicant: KHS GmbH, Dortmund (DE)

(72) Inventors: Ludwig Clüsserath, Bad Kreuznach (DE); Manfred Härtel, Weilerbach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 218 days.

(21) Appl. No.: 14/774,350

(22) PCT Filed: Mar. 1, 2014

(86) PCT No.: PCT/EP2014/000534

§ 371 (c)(1),
(2) Date: Sep. 10, 2015

(87) PCT Pub. No.: WO2014/139641

PCT Pub. Date: Sep. 18, 2014

(65) Prior Publication Data

US 2016/0016774 A1 Jan. 21, 2016

(30) Foreign Application Priority Data

Mar. 13, 2013 (DE) ..... 10 2013 102 547

(51) Int. Cl.

| | |
|---|---|
| ***B67C 3/10*** | (2006.01) |
| ***B67C 3/26*** | (2006.01) |
| ***B67C 3/22*** | (2006.01) |

(52) U.S. Cl.

CPC ..... *B67C 3/10* (2013.01); *B67C 3/225* (2013.01); *B67C 3/2617* (2013.01); *B67C 2003/2602* (2013.01); *B67C 2003/2651* (2013.01); *B67C 2003/2657* (2013.01)

(58) Field of Classification Search

CPC ..... B67C 3/10; B67C 3/225; B67C 3/2617; B67C 2003/2651; B67C 2003/2657; B67C 2003/2602

See application file for complete search history.

(56) References Cited

U.S. PATENT DOCUMENTS

| | | | |
|---|---|---|---|
| 5,501,253 | A | 3/1996 | Weiss |
| 5,884,677 | A | 3/1999 | McKaughan |

FOREIGN PATENT DOCUMENTS

| | | |
|---|---|---|
| DE | 37 31 757 | 3/1989 |
| DE | 38 36 489 | 5/1990 |
| DE | 93 01 420 | 3/1994 |
| DE | 199 39 521 | 9/2000 |

(Continued)

*Primary Examiner* — Jason K Niesz
(74) *Attorney, Agent, or Firm* — Occhiuti & Rohlicek LLP

(57) ABSTRACT

A method for operating a filling machine includes conducting purgative gas via a first controlled gas path from a first ring channel common to all filling elements to the interior of a container sealed against a filling element via a controllable choke arrangement that switches between choking state and non-choking states, draining the purgative gas out of the container's interior through return-gas openings and into return-gas channels of a second controlled gas path, the first and second return-gas channels being controlled by corresponding first and second control valves that are operable independently of each other, and pressure-filling the container with the liquid contents.

22 Claims, 7 Drawing Sheets

(56) References Cited

FOREIGN PATENT DOCUMENTS

| | | |
|---|---|---|
| DE | 201 10 362 | 8/2001 |
| DE | 100 64 954 | 6/2002 |
| DE | 103 43 281 | 4/2005 |
| DE | 10 2010 02298 | 12/2011 |
| EP | 0 582 190 | 2/1994 |
| JP | 2005 313928 | 11/2005 |

METHOD AND FILLING MACHINE FOR FILLING CANS OR THE LIKE CONTAINERS WITH LIQUID CONTENTS

RELATED APPLICATIONS

This application is the national stage under 35 USC 371 of international application PCT/EP2014/000534, filed on Mar. 1, 2014, which claims the benefit of the Mar. 13, 2013 priority date of German application DE 102013102547.1, the contents of which are herein incorporated by reference.

FIELD OF INVENTION

This invention relates to packaging, and in particular, to filling machines.

BACKGROUND

Filling machines for filling containers are known. It is also known to purge the inside of a container before filling it. This is done by sealing the container against a filling element and allowing a purgative gas to fill the container. A typical purgative gas is carbon dioxide. It is also known to introduce the purgative gas along a vertical filling element axis and into the bottle interior, and to conduct away such gas from the bottle interior via a controlled gas-path.

SUMMARY

An object of the invention is to provide a method that also allows a container, and in particular, a can, to have its interior purged.

A particular feature of the invention is that of purging a container by introducing purgative gas takes place exclusively through a constricted gas path with reduced flow cross-section, and draining purgative gas from the container via an unconstricted gas path with a substantially larger flow cross-section. As a result, purgative gas flows into a container with both low pressure and high throughput.

In some practices, the pressure above atmospheric pressure is only 0 bar to 3.0 bar. In others, it is between 0 bar to 2.0 bar. In yet other practices, it is between 0.5 bar to 1 bar. At least during filling, the unconstricted gas path exhibits its full flow cross-section, without any reduction as a result of a choke. This results in a rapid pre-loading and filling of the containers.

In one aspect, the invention features a method for operating a filling machine for filling containers with liquid contents. Such a method includes sealing the container against a filling element, conducting purgative gas via a first controlled gas-path from a first ring channel common to all filling elements of the filling machine to the container's interior via a controllable choke arrangement that can switch between a first choke-state in which the controllable choke arrangement chokes gas flow and a second choke-state in which the controllable choke arrangement allows free gas flow, the controllable choke arrangement being in the first choke-state, thereby reducing pressure of the purgative gas to a purge pressure, draining the purgative gas from the container, which is flowing at a purge pressure of between 0 bar and 2 bar above ambient pressure, out of the container's interior through first and second return-gas openings of the filling element and into first and second return-gas channels of a second controlled gas-path of the filling element, the first and second return-gas channels being controlled by corresponding first and second control valves that are operable independently of each other, and pressure-filling the container with the liquid contents.

Practices of the invention include those in which the first ring channel is maintained at an under-pressure.

Other practices include those in which draining the purgative gas comprises draining the purgative gas through openings that are offset by 180° around a filling element axis of the filling element.

Yet other practices include those in which sealing the container comprises sealing a mouth of the container against a ring seal.

Some practices include causing the controllable choke arrangement to switch into the second choke-state. In these practices, wherein pressure filling the container comprises causing the liquid contents to force the purgative gas out of the container's interior via the second controlled gas-path and into a second ring channel. These practices include those in which the controllable choke arrangement comprises a non-return valve arranged parallel to a choke, wherein, except for flow into the second ring channel, the non-return valve prevents flow, those in which the choke arrangement comprises a choke having a changeable flow cross-section, and those in which the controllable choke arrangement comprises a control valve and a choke arranged parallel to the control valve.

Yet other practices include those in which pressure-filling the container comprise comprising causing the choke arrangement to be in the second state when a liquid-dispensing valve of the filling element permits liquid content to flow into the container.

Some practices of the invention include controlling choke-state of the choke by causing motion of a valve tappet that moves in response to opening and closing of the liquid-dispensing valve.

Yet other practices include closing the first and second control valves of the return-gas channels during pre-loading of the container before filling the container.

As used herein, "container" includes cans, such as those normally used for beverages, and can-like containers, such as kegs for beer, including PET kegs, and containers in which the cross-section of the container opening is only slightly smaller than the cross-section of the container interior.

The method disclosed herein is not limited to liquid filling-material but can also be used for inert gas purging of bottles.

As used herein, "pressure filling" refers to a filling method in which the containers to be filled are sealed against a filling element. Usually, before the actual filling phase, i.e. before the opening of a liquid-dispensing valve, the containers are pre-loaded via at least one controlled gas-path formed in the filling element.

Pre-loading involves filling with a purgative gas under pressure. Typical purgative gases include inert gas or CO2 gas. Liquid contents flowing into the container force the gas out of the container's interior via a controlled gas-path formed in the filling element.

As used herein, expressions such as "essentially" or "some" indicate deviations from an exact value by ±10%, preferably by ±5%, and/or deviations that are not of significance to function.

Further embodiments, advantages, and application possibilities of the invention derive from the following description of exemplary embodiments and from the figures. In this context, all the features described and/or pictorially represented are in principle the object of the invention, alone or in any desired combination, regardless of their combination in the claims or reference made to them. The contents of the claims are likewise made a constituent part of the description.

BRIEF DESCRIPTION OF THE DRAWINGS

These and other features of the invention will be apparent from the following detailed description and the accompanying figures, in which.

DETAILED DESCRIPTION

Figure 1:
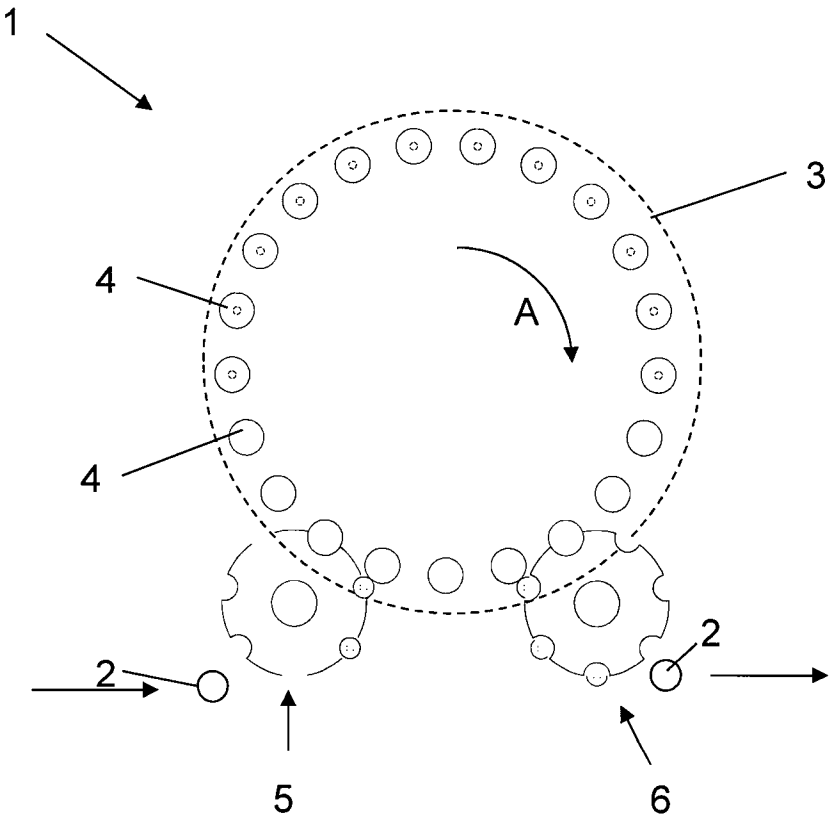
FIG. 1 shows a view from above a filling machine for the filling of cans with liquid filling-material.

FIG. 1 shows a filling machine 1 for pressure filling containers 2 with filling-material. Examples of filling-material include beer and soft drinks. An example of a container is a can.

The filling machine 1 includes a rotor 3 that rotates about a vertical machine-axis MA. The rotor's periphery has filling positions 4 disposed thereon. Empty containers 2 are conducted to the filling points 4 via a container inlet 5. Filled containers are removed at a container outlet 6.

Filling takes place within an angle range of the rotational movement A of the rotor 3. The angle range extends between the container inlet 5 and the container outlet 6. During filling, containers 2 are arranged with their container axes parallel to a vertical machine-axis MA and coaxially with a filling-point axis FA of the filling point 4.

This process described herein is for rotational filling machines. However, a similar process can be carried out with linear filling machines. As a result, large PET containers, such as those used as beer kegs, can also be filled in this manner.

Figure 2:
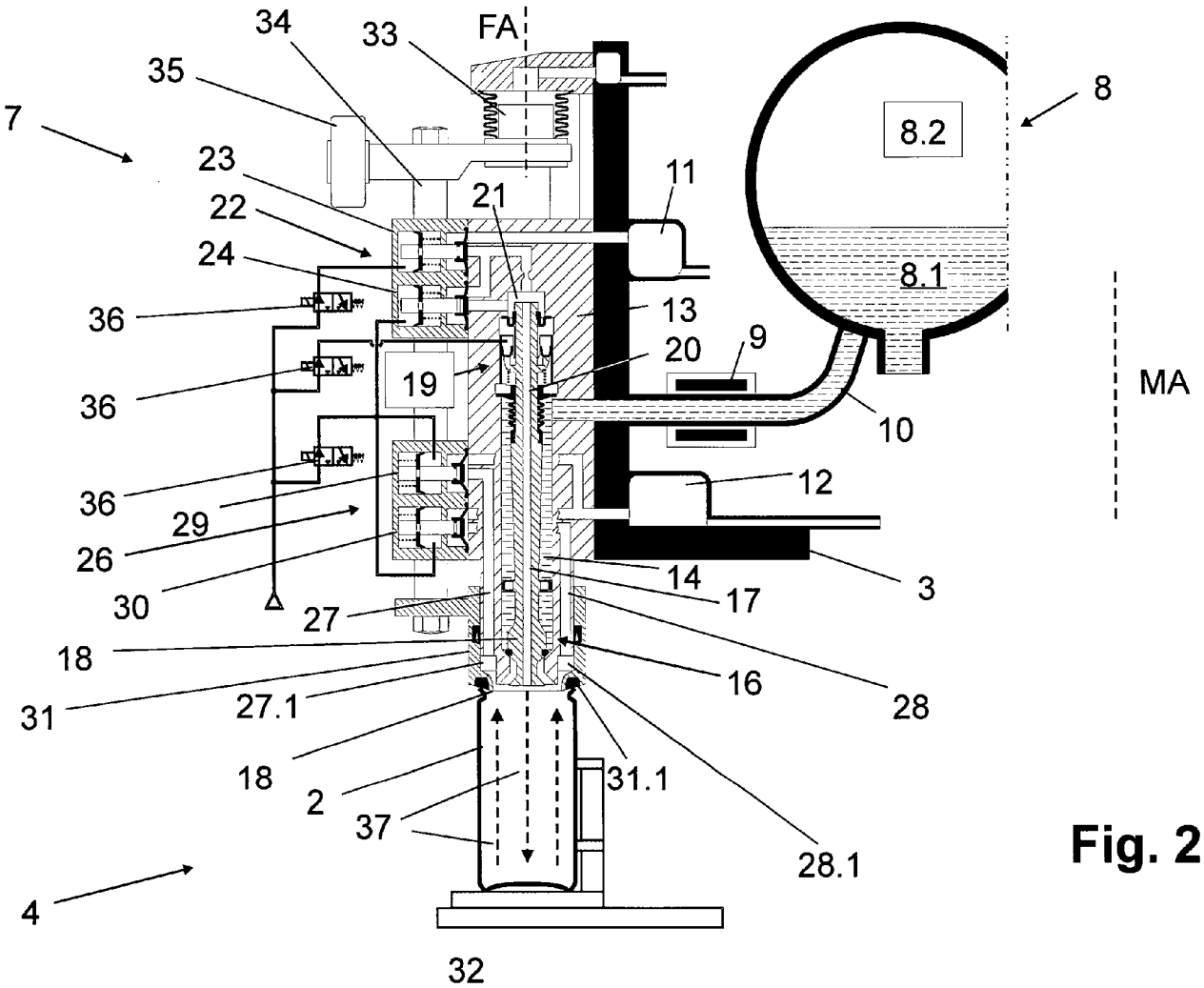
FIG. 2 shows a filling position of the filing machine from FIG. 1, together with a can arranged in a sealed position at the filling element.

Referring to FIG. 2, a filling point 4 includes a filling element 7. This filling element 7, together with the filling elements 7 of the other filling points 4, is arranged at the periphery of the rotor 3.

Also located at the rotor 3 is a filling-material tank 8. In the illustrated embodiment, the filling-material tank 8 is a ring tank. During the filling operation, the filling-material tank 8 is partially filled with the filling-material. The filling material defines a liquid-filled portion 8.1 that holds liquid. Inert gas above the liquid-filled portion 8.1 forms a gas-filled portion 8.2 that holds a gas. The inert gas is maintained at a filling pressure PF. In some embodiments, the filling pressure is between 3 bar and 5 bar. Suitable choices for an inert gas include CO2 gas and nitrogen.

A product line 10 with an in-line flow meter 9 connects the liquid-filled portion 8.1 to the filling element 7. Similar product lines connect the liquid-filled portion 8.1 to other filling elements. As a result, the filling-material tank 8 is common to all the filling points 4 on the rotor 3.

The rotor 3 also supports upper and lower ring-channels 11, 12 that surround the vertical machine-axis MA. Like the filling-material tank 8, the upper and lower ring-channels 11, 12 are common to all the filling points 4 and filling elements 7.

During filling, the upper ring-channel 11 conducts inert gas. The lower ring-channel 12 accumulates return gas collected from the filling elements 7 during the purging of the container 2. The pressure in the upper ring-channel 11 is equal, or essentially equal or slightly less than the filling pressure PF in the gas-filled portion 8.2. The pressure in the lower ring-channel 12 is atmospheric pressure or below.

The filling element 7 is formed in a filling-element housing 13 with a liquid-carrying channel 14. An upper region of the liquid-carrying channel 14 connects to the product line 10. A lower end of the liquid-carrying channel 14 terminates on an underside of the filling element 7, where it forms a ring-shaped outlet opening 15 that concentrically surrounds the filling-point axis FA and through which liquid filling-material flows into a container 2 during filling.

FIG. 2 shows a liquid-dispensing valve 16 in the liquid-carrying channel 14 upstream of the outlet opening 15. The liquid-dispensing valve 16 is formed from a valve body 18 that is arranged at a valve tappet 17. As shown in FIG. 2, the valve body 18 of the liquid-dispensing valve 16 contacts a valve surface in the liquid-carrying channel 14. In this state, the liquid-dispensing valve 16 is closed. To open it, an actuator 19 raises the valve body 18 with the valve tappet 17. Preferably, the actuator 19 is a pneumatically controlled actuator 19.

The valve tappet 17 includes a gas channel 20 that is coaxial with the filling-point axis FA. The gas channel 20 opens on the underside in the region of the outlet opening 15. An upper end of the valve tappet 17 opens into a gas-filled chamber 21 formed in the filling-element housing 13.

During the pressure filling of the containers 2, it is useful to control the different phases of the filling process. To achieve this, the apparatus includes a first control-valve 23, a second control-valve 24, a third control-valve 29, and a fourth control-valve 30. These control valves 23, 24, 29, 30 are disposed along first and second controlled gas-path s 22, 26 formed in the filling-element housing 13. In one implementation, the control valves 23, 24, 29, 30 are pneumatically actuated valves.

Figure 3:
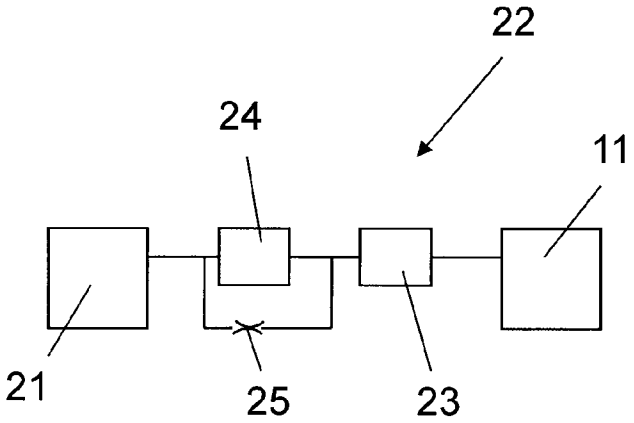
FIGS. 3 and 4, show controlled gas-paths of the filling element of the filling position from FIG. 2.
Figure 4:
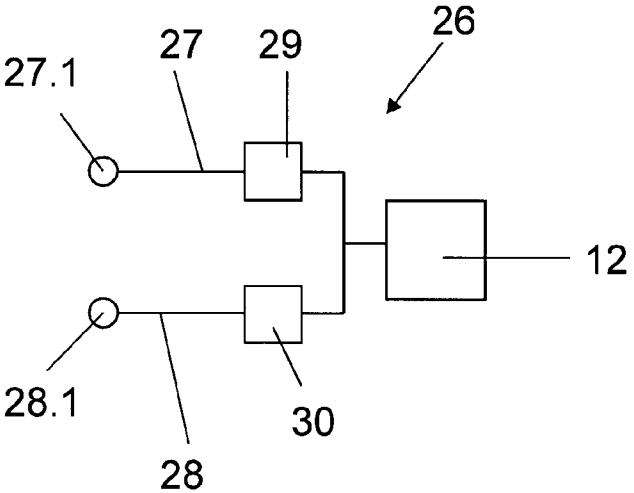

FIGS. 3 and 4 show the topologies of the connections between the first and second controlled gas-path s 22, 26 and the upper and lower ring-channels 11, 12.

Referring to FIG. 3, the first controlled gas-path 22 connects the gas-filled chamber 21 and the upper ring-channel 11 in a controlled manner. Control over the connection comes from placing control elements in series along a flow path extending between the gas-filled chamber 21 and the upper ring-channel 11. One control element is the first control-valve 23. Another control element is the parallel combination of a second control-valve 24 and a choke 25.

The choke 25 has a fixed reduced flow cross-section. When the second control-valve 24 is closed, the choke 25 allows a gas flow through a parallel bypass that bypasses the closed second control-valve 24. As a result, by opening and closing the second control-valve 24, it is possible to change the effective flow cross-section of the first controlled gas-path 22.

Referring back to FIG. 2, the filling-element housing 13 has first and second return-gas channels 27, 28 that extend vertically through the filling-element housing 13 in a direction parallel to the filling-point axis FA. The first and second return-gas channels 27, 28 are part of the second controllable gas path 26. The third control-valve 29 is along the first return-gas channel 27. The fourth control-valve 30 is along the second return-gas channel 28.

The first return-gas channel 27 ends, at its lower end, at a first return-gas opening 27.1. Similarly, the second return-gas channel 28 ends, at its lower end, at a second return-gas opening 28.1. The first and second return-gas openings 27.1, 28.1 are at the underside of the filling element 7 opposite the outlet opening 15. They are offset both radially outwards in relation to the filling-point axis FA, and axially above the outlet opening 15 along the direction of the filling-point axis FA. In the embodiment represented, the first and second return-gas openings 27.1, 28.1 are offset by 180° about the filling-point axis FA.

Referring to FIG. 4, the second controlled gas-path 26 connects the first and second return-gas openings 27.1, 28.1 to the lower ring-channel 12. As shown in the figures, the inlets of the third and fourth control-valves 29, 30 connect to the corresponding first and second return-gas channels 27, 28 respectively. The outlets of both the third and fourth control-valves 29, 30 connect to the lower ring-channel 12.

Referring back to FIG. 2, the filling element 7 further comprises a centering cone 31 and an associated ring seal 31.1. During purging, pre-loading, and filling, the ring seal 31.1 seals the centering cone 31 against an opening edge of a container 2 that is standing on a container carrier 32. This results in a sealed space into which the outlet opening 15, the lower end of the gas channel 20, the first return-gas opening 27.1, and the second return-gas opening 28.1 all open.

A bellows 33, which is subjected to the filling pressure PF, acts, via a linkage 34, to pre-tension the centering cone 31 into its lower position so that it is located tightly against the container 2. Interaction of a curved roller 35 provided at the linkage 34 with an outer lifting curve that does not circulate with the rotor 3 either lifts or lowers the centering cone 31 to either seal the container or facilitate its removal.

Electro-pneumatic actuators 36 actuate the pneumatically actuated control-valves 23, 24, 29, 30. These actuators 36 are controlled by a machine control-system of the filling machine 1. The process by which the filling element 7 carries out pressure filling of containers 2 is described as follows.

An initial step is that of pushing the container 2 into the filling point 4. This is carried out by closing the liquid-dispensing valve 16, the first control-valve 23, and the second control-valve 24. Then, the third control-valve 29 and the fourth control-valve 30 are opened. This opens the second controlled gas-path 26. The centering cone 31 is also raised against the effect of the bellows 33.

The next step is that of purging the container interior with inert gas. During this process, the container 2 is located in the sealed position at the filling element 7. In this sealed position, the centering cone 31 is lowered with its ring seal 31.1 pressed tightly against the container 2.

The liquid-dispensing valve 16 is then closed, and the first control-valve 23, the third control-valve 29, and the fourth control-valve 30 are all opened. The second control-valve 24, however, remains closed. As a result, purgative gas from the upper ring-channel 11 flows via the choke 25 into the gas-filled chamber 21. From there, the purgative gas continues through the gas channel 20, which sends it along a path straight down the central zone of the container's interior. Upon reaching the base of the container 2, the gas is deflected back upwards along the periphery of the container 2. This results in a circulating flow 37.

The purgative gas, together with any air purged from the container 2, enters the first and second return-gas openings 27.1, 28.1 and the now-opened second controlled gas-path 26 to be carried away by the ring channel 12. As noted above, the lower ring-channel 12 is maintained at or slightly below atmospheric pressure. This promotes flow through the second controlled gas-path 26

Because of the choke 25 in the first controlled gas-path 22 and the parallel first and second return-gas channels 27 and 28, the flow cross-section of the second controlled gas-path 26 is significantly greater than the effective flow cross-section of the first controlled gas-path 22. As a result, air carried into a container at a purging pressure, Ps, that is between the atmospheric pressure and an overpressure of some 0.5 bar to 2.0 bar, preferably of some 1.0 bar, is forced in a very short time out of the container interior and replaced by inert gas (for example $CO_2$ gas or nitrogen).

There are three factors that contribute to this advantage.

First, purgative gas is conducted to the container interior via the choke 25 of the first controlled gas-path 22. As a result, the pressure of the purgative gas flowing to the container 2 is perceptibly reduced in relation to the pressure in the upper ring-channel 11.

Second, as a result of the choke 25, the flow cross-section of the second controlled gas-path 26 is greater than the effective flow cross-section of the first controlled gas-path 22. As a result, high gas-throughputs are obtained inside the container 2 at reduced purge pressure Ps. This high gas-throughput is further enhanced by under-pressure in the lower ring-channel 12.

Third, the configuration avoids formation of a significant vortex of purgative gas with air. Such a vortex would otherwise impair the purge process.

Fourth, the first and second return-gas openings 27.1, 28.1 are offset by 180° about the filling-point axis FA and are located inside the ring seal 31.1 directly at its sealing point and therefore directly at the inner side of the opening edge of the container 2. As a result, the radial distance from the return-gas openings 27.1 and 28.1 to the filling-point axis FA is equal to or only slightly smaller than the corresponding distance between the inner side of the ring seal 31.1 and the filling-point axis FA.

The reduction in purge time means that the filling machine 1 can fill more containers 2 per unit time. Additionally, the shorter purge time means lower gas consumption.

The next step is to pre-load the container's interior with inert gas. This is carried out with the container 2 still being sealed against the filling element 7 and with the centering cone 31 lowered.

To carry out this pre-loading step, the liquid-dispensing valve 16, the third control-valve 29, and the fourth control-valve 3 are all closed. The first and second control-valves 23 and 24 are opened. This increases the effective flow cross-section of the first controlled gas-path 22 by allowing inert gas as pre-loading gas to at least partially bypass the choke 25. The container's interior is thus promptly pre-loaded with inert gas at a pressure that is the same or essentially the same as the filling pressure PF.

Next comes the actual pressure filling. This is carried out with the container 2 still in the sealed position at the filling element 7.

In this step, the third and fourth control-valves 29, 30 are closed, thus closing the second controlled gas-path 26. Meanwhile, the first and second control-valves 23, 24 are opened.

Then, the liquid-dispensing valve 16 opens to begin the filling phase. This causes liquid filling-material to flow via the outlet opening 15 into the container, and specifically through the conical formation of the liquid-carrying channel 14 in the region of the outlet opening 15 along the inner surface of the container. Meanwhile, the completely open gas channel 20 and the completely opened first controlled gas-path 22 conduct inert gas that has been forced out of the container 2 back into the upper ring-channel 11. The flow meter 9 monitors the quantity of the filling-material flowing to the container 2. Once the required filling quantity is reached, the flow meter 9 sends a signal that causes the actuator 19 to close the liquid-dispensing valve 16.

The next step is to relieve pressure from the interior of the now-filled container 2.

With the container 2 still located in the sealing position at the filling element, and with the liquid-dispensing valve 16, the first control-valve 23, and the second control-valve 24 all closed, at least one of the third and fourth control-valves 29, 30 is opened. In a preferred embodiment, both the third and fourth control-valves 29, 30 open. This allowed excess pressure in the head space of the container 2 to be relieved into the lower ring-channel 12 by the second controlled gas-path 26.

Finally, the filled container 2 is released. This is carried out with the liquid-dispensing valve 16 closed, the first and second control-valves 23, 24 closed, and with the third and fourth control-valves 29, 30 open. The centering cone 31 is raised by the control curve interacting with the curve roller 35 such that the filled container 2 can be removed at the container outlet 6.

In some embodiments, the filling element 7 can carry out further process steps. For example, the filling element 7 can also carry out a slow top-up filling and/or a slow filling before closing the liquid-dispensing valve 16. To do so, the first control-valve 23 is open and the second control-valve 24 is closed.

Figure 5:
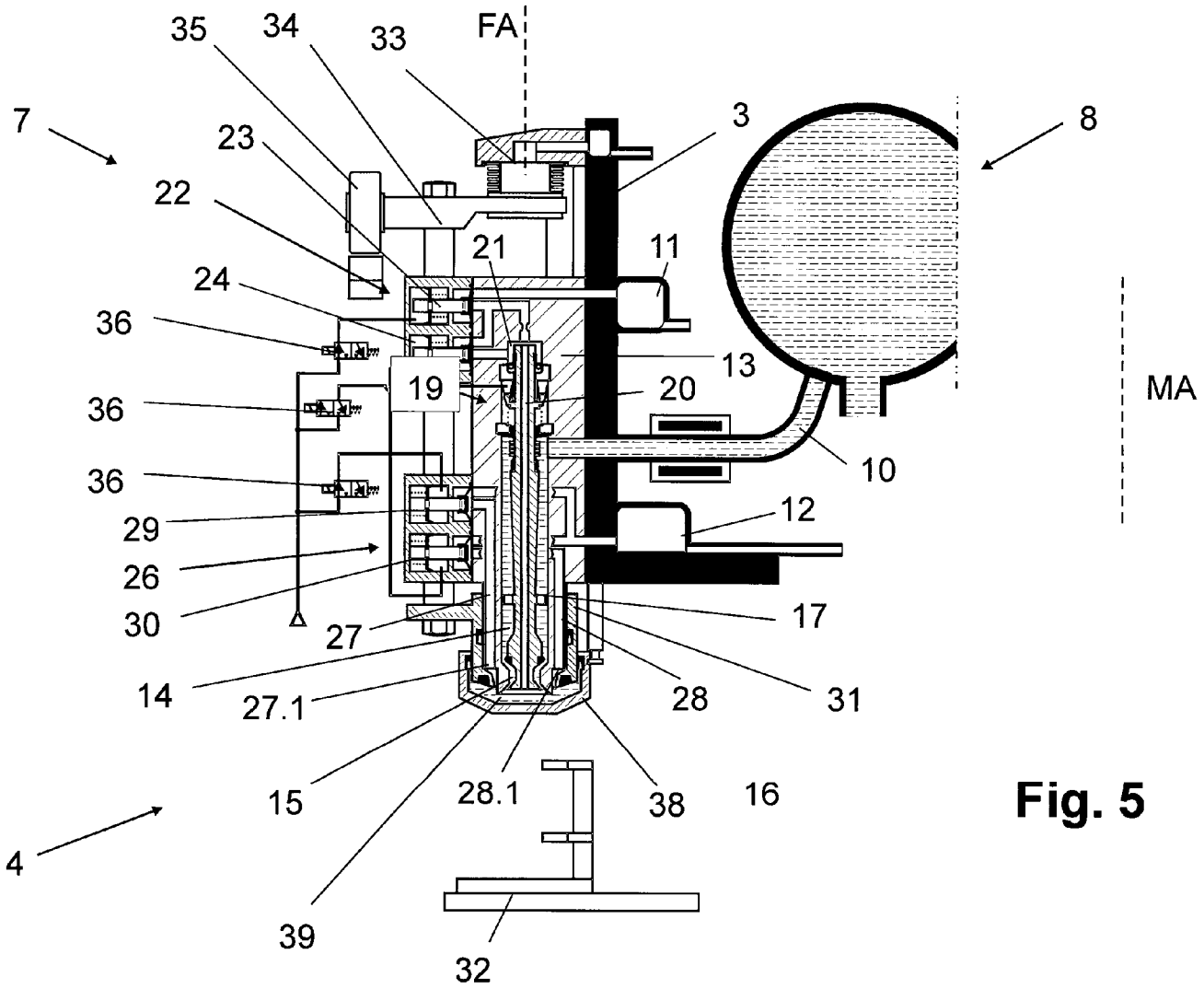
FIG. 5 shows the filling position from FIG. 2 configured for a CIP cleaning and/or CIP disinfection.

FIG. 5 shows the filling element 7 in a cleaning and/or disinfection operating state or CIP mode (CIP cleaning and/or disinfection) of the filling machine 1. In this state, there is a purge cap 38 on the underside of each filling elements 7. This forms a purge space 39 closed to the surroundings and into which outlet opening 15, the lower, open end of the gas channel 20, and the first and second return-gas openings 27.1 and 28.1 open.

During this CIP cleaning and/or disinfection, the filling-material tank 8 is filled with a liquid cleaning and/or disinfection medium or CIP medium respectively. The first and second control-valves 23, 24 are closed, thus closing the first controlled gas-path 22. The third and fourth control-valves 29, 30 are opened, such that the CIP medium can flow out of the tank 8, through the liquid-carrying channel 16, through the outlet opening 15, through the purge space 39, through the first and second return-gas channels 27, 28, and into the ring channel 12, from which the CIP medium is drained off.

During CIP cleaning and/or disinfection, opening the third and fourth control-valves 29, 30 forms a wide open second controlled gas-path 26 having a large effective flow cross-section for the CIP medium and therefore a high CIP medium throughput. This promotes intensive CIP treatment.

It is also possible to close the third and fourth control-valves 29, 30 and open the first and second control-valves 23, 24. With the liquid-dispensing valve 16 still opened, the first controlled gas-path 22 can also be treated with the CIP medium from the filling-material tank 8, which is then drained off via the upper ring-channel 11.

Among the particular features of the filling machine 1 is that, during the purging of a container, purgative gas exits via a gas path that has a greater cross-section than that gas path that it used to enter. In particular, purgative gas enters via the choke 25 and exits via the second controlled gas-path 26 with a substantially greater flow cross-section. As a result, despite a high throughput, purgative gas flows to the container 2 at a reduced purgative gas pressure. An overpressure predominates in the container 2. This overpressure is lower than the filling pressure PF. In some embodiments, it is lower by as much as 2.0 bar. Embodiments also include those in which it is lower by between 0.5 bar and 2.0 bar, and those in which it is lower by 0.5-1.0 bar. Both during pre-loading, as well as during filling, the first and second control-valves 23, 24 are opened, thus giving the first controlled gas-path 22 its full flow cross-section. This results in rapid pre-loading and filling of the containers 2.

In some embodiments, all the control valves 23, 24, 29, 30 have the same design. Each one is pre-tensioned by internal spring means into a first state. To cause transition into a second state, a control pressure overcomes the bias of the internal spring. In the first and second control-valves 23, 24, the first state is one in which the valves are open. In contrast, in the case of the third and fourth control-valves 24, 29, the first state is one in which they are closed.

With the foregoing configuration, only the first control-valve 23 needs an independent electropneumatic actuator 36. A common electropneumatic actuator 36 actuates the second, third, and fourth control-valves 24, 29, 30. During purging, the common electropneumatic actuator 36 imposes a control pressure that closes the second control-valve 24 and opens the third and fourth control-valves 29, 30. During pre-loading and filling, the common electropneumatic actuator 36 remains inactive. Therefore, the first and second control-valves 23, 24 are in their default open state and the third and fourth control-valves 29, 30 are in their default closed states. A third electropneumatic control actuator 36 actuates the actuator 19. This considerably simplifies actuation of the control-valves 23, 24, 29, 30 by the electropneumatic actuators 36

Figure 6:
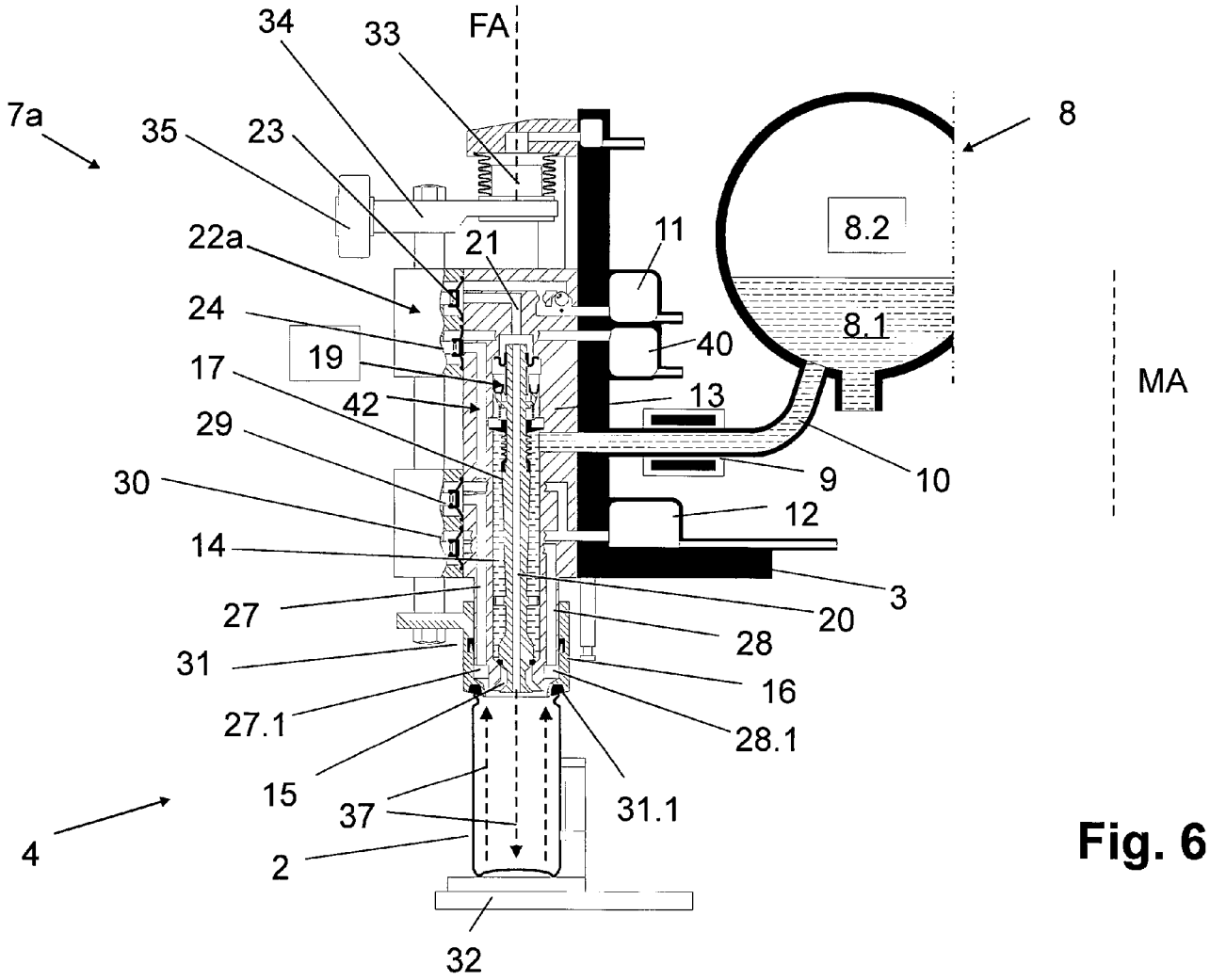
FIG. 6 shows a further embodiment of the filling position in FIG. 2.

FIG. 6 shows as a further embodiment of a filling machine 1*a* having an alternative filling element 7*a*. The further embodiment filling machine 1*a* features a further ring tank 40 at the rotor 3. The further ring tank 40 serves as a common relief channel for all the filling elements 7*a*.

Figure 7:
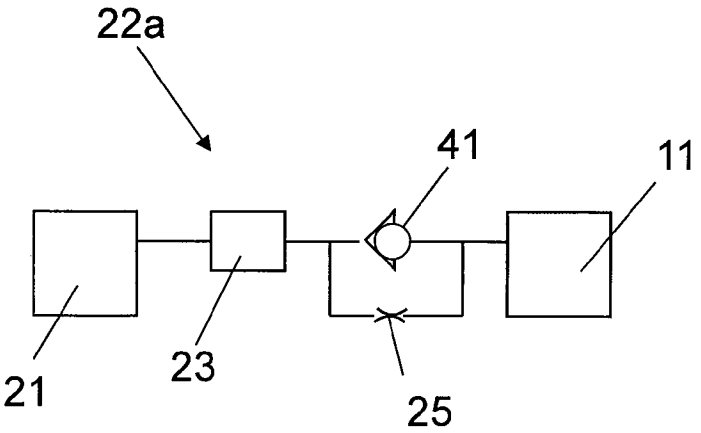
FIGS. 7 and 8 show controlled gas-paths of the filling element from FIG. 6.
Figure 8:
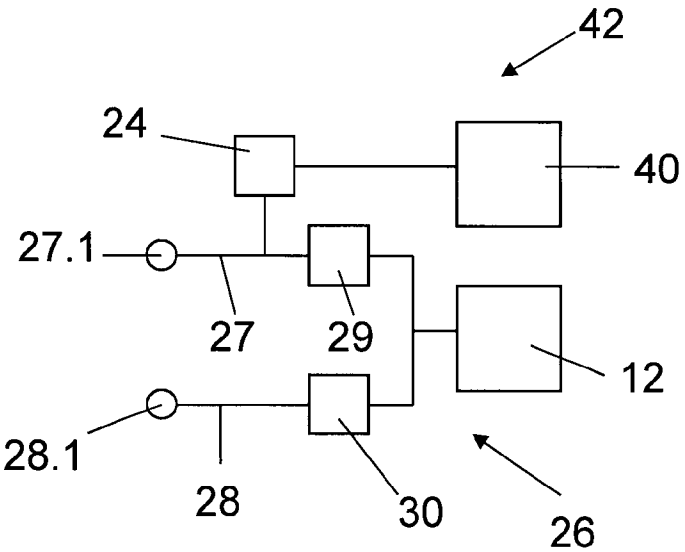

As shown in FIGS. 7 and 8, the alternative filling element 7*a* has a somewhat different topology for connecting the upper ring-channel 11 to the gas-filled chamber 21 and for connecting the lower ring-channel to the first and second return-gas openings 27.1, 28.1. In particular, the first controlled gas-path 22 of FIG. 3 is replaced by an alternative first controlled gas-path 22*a* in FIG. 7, and a third controlled gas-path 42 is added as shown in FIG. 8.

As shown in FIG. 7, the alternative first controlled gas path 22*a* has only a first control-valve 23. Instead of another control valve parallel to the choke 25, the alternative first controlled gas-path 22*a* has a non-return valve 41. The non-return valve 41 is closed for flow out of the upper ring-channel 11 and opened for flow into the upper ring-channel 11.

The method steps of purging and pre-loading of containers 2 with inert gas under a filling pressure PF from the upper ring-channel 11 and pressure filling of the containers 2, with return feed of the inert gas which is thereby forced out of the containers 2 both take place in a manner analogous to the corresponding steps described in connection with the filling element 7.

During purging, with the first control-valve 23 opened and with the non-return valve 41 blocking, once again, by way of the choke 25 in conjunction with the first and second controlled gas paths 27, 28, the purgative gas is conducted out of the upper ring-channel 11 with reduced purge pressure Ps in the container 2, and flows through with high throughput. With the first control-valve 23 open, the pre-loading of the containers 2 takes place solely via the choke 25.

During the pressure filling of the containers 2, the inert gas forced out by the inflowing filling-material, with the first control-valve 23 open, is conducted back into the upper ring-channel 11 both via the choke 25 and via the now open non-return valve 41. The greater part of the flow is, however, via the non-return valve 41.

As shown in FIG. 8, a second controlled gas-path 26 provides a connection between the first and second return-gas openings 27.1 in a manner already described in connection with FIG. 4. The first return-gas opening 27.1 connects to the lower ring-channel 12 via a second control-valve 29 in the first return-gas channel 27. Similarly, the second gas opening 28.1 connects to the lower ring-channel 12 via a third control-valve 30 in the second return-gas channel 28.

However, unlike the embodiment shown in FIG. 4, the embodiment shown in FIG. 8 features a third controlled gas-path 42 that connects the further ring tank 40 to the first return-gas opening 27.1 by way of a fourth control-valve 24. This third controlled gas-path 42 provides a way to vent excess gas into the further ring tank 40 during pressure release of a filled container 2.

During the pressure relief phase, the first, second, and third control-valves 23, 29, 30 are closed, and the fourth control-valve 24 is opened. This opens the third controlled gas-path 42 so that pressure relief takes place into the further ring tank 40.

With the alternative filling element 7*a*, therefore, the flow of the inert gas during the purging, pre-loading, and filling also takes place via the first controlled gas-path 22*a*. This flow occurs with reduced flow cross-section during purging and pre-loading, but with the entire flow cross-section during filling.

Figure 10:
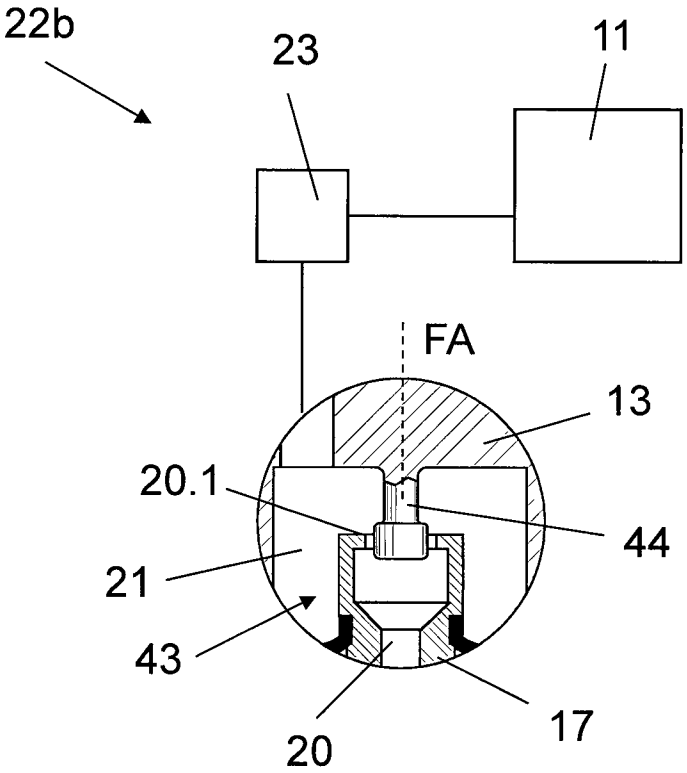
FIGS. 9 and 10 show a controlled gas-path in different operating states.
Figure 9:
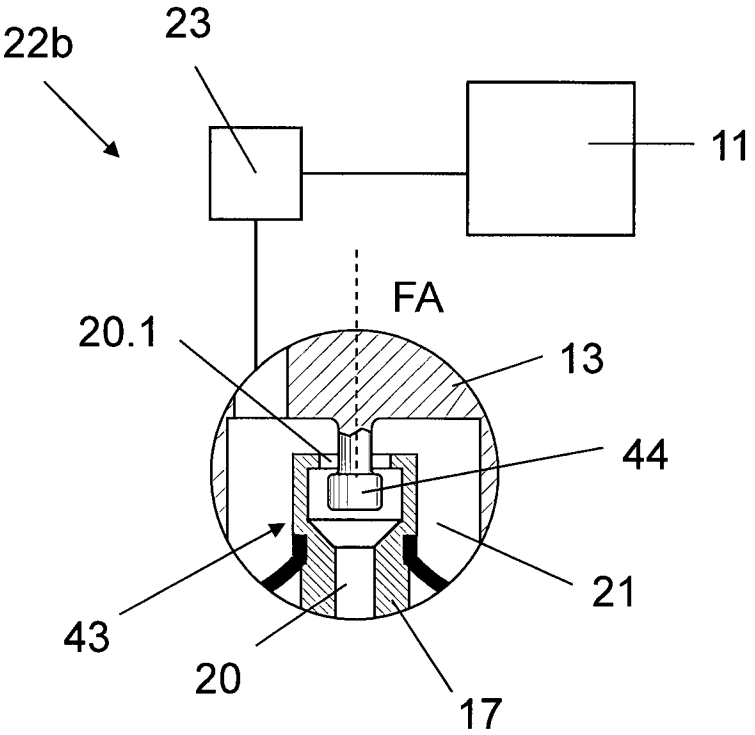

FIGS. 9 and 10 show the filling-element housing 13 in the region of the gas-filled chamber 21 with a filling element 7*b* according to a further embodiment of the invention, and specifically with a first controlled gas-path 22*b* in the connection between the upper ring-channel 11 and the gas channel 20. In this embodiment, the gas-filled chamber 21 is a part of a first controlled gas-path 22*b* having a changeable choke 43 that is arranged in the first controlled gas-path 22*b* in operational effect in series with a first control-valve 23.

The changeable choke 42 is controllable between a first state, shown in FIG. 10, and a second state, shown in FIG. 9. In the first state, the changeable choke 43 has a reduced choke cross-section. In the second state, the changeable choke 43 has an enlarged choke cross-section.

The changeable choke 43 is formed at an upper end of the valve tappet 17, and specifically at a choke opening 20.1 of the gas channel 20. The changeable choke 43 is formed in such a way that raising the valve tappet 17 enlarges the choke opening 20.1 and lowering the valve tappet 17 constricts the choke opening 20.1.

As a result of this automatic change in the choke opening's cross-section, there is no need for a further control-valve. Instead, the choke opening 20.1 changes automatically.

During purging and pre-loading from the upper ring-channel 11 that takes place via the second gas path 22*b* with the choke opening 20.1 at its reduced flow cross-section, as shown in FIG. 10. In contrast, the return of inert gas forced out by the filling filling-material during pressure filling takes place with the choke opening 20.1 at its enlarged cross-section, as shown in FIG. 9.

In one embodiment, the changeable choke 43 has a choke body 44 that does not move with the valve tappet 17. Instead, the choke body 44 is secured to the filling-element housing 13 so that it is coaxial with the filling-point axis FA. This choke body 44 extends into the choke opening 20.1.

The choke body 44 is shaped like a mushroom head. In particular, the choke body 44 has a first cylindrical section having a first radius and a second cylindrical section having a second radius that is greater than the first radius. In the first state, shown in FIG. 10, the second section is in the choke opening 20.1. In the second state, as shown in FIG. 9, the first section is in the choke opening 20.1 while the second section is accommodated within an extension of the gas channel 20.

The invention has been described by way of exemplary embodiments. It is understood that numerous modifications and derivations are possible without departing from the inventive concept on which the invention is based.

The invention claimed is:

1. A method for operating a filling machine for filling containers with liquid contents, said method comprising sealing said container against a filling element, conducting purgative gas via a first controlled gas path from a first ring channel common to all filling elements of said filling machine to said container's interior via a controllable choke arrangement that can switch between a first choke-state in which said controllable choke arrangement chokes gas flow and a second choke-state in which said controllable choke arrangement allows free gas flow, said controllable choke arrangement being in said first choke-state, thereby reducing pressure of said purgative gas to a purge pressure, draining said purgative gas from said container, which is flowing at a purge pressure of between 0 bar and 2 bar above ambient pressure, out of said container's interior through first and second return-gas openings of said filling element and into first and second return-gas channels of a second controlled gas path of said filling element, said first and second return-gas channels being controlled by corresponding first and second control valves that are operable independently of each other, and pressure-filling said container with said liquid contents.

2. The method of claim 1, further comprising maintaining said first ring channel at an under-pressure.

3. The method of claim 1, wherein draining said purgative gas comprises draining said purgative gas through openings that are offset by 180° around a filling element axis of said filling element.

4. The method of claim 1, wherein sealing said container comprises sealing a mouth of said container against a ring seal.

5. The method of claim 1, further comprising causing said controllable choke arrangement to switch into said second choke-state, and wherein pressure filling said container comprises causing said liquid contents to force said purgative gas out of said container's interior via said second controlled gas path and into a second ring channel.

6. The method of claim 1, wherein said controllable choke arrangement comprises a non-return valve arranged parallel to a choke, wherein, except for flow into said second ring channel, said non-return valve prevents flow.

7. The method of claim 1, wherein said controllable choke arrangement comprises a choke having a changeable flow cross-section.

8. The method of claim 1, wherein said controllable choke arrangement comprises a control valve and a choke arranged parallel to said control valve.

9. The method of claim 5, wherein pressure-filling said container comprise comprising causing said choke arrangement to be in said second state when a liquid-dispensing valve of said filling element permits liquid content to flow into said container.

10. The method of claim 1, further comprising controlling choke-state of said choke by causing motion of a valve tappet that moves in response to opening and closing of said liquid-dispensing valve.

11. The method of claim 1, further comprising closing said first and second control valves of said return-gas channels during pre-loading of said container before filling said container.

12. An apparatus for pressure-filling of containers, said apparatus comprising a rotor, a first ring channel, a tank, and a plurality of filling elements, wherein said tank contains liquid contents to be delivered to each of said filling elements for filling into containers, wherein said first ring channel conducts inert gas under pressure to all of said filling elements, wherein said filling elements are disposed around said rotor, wherein said filling elements comprise a first filling element, wherein said first filling element comprises a housing, a liquid-dispensing valve, a ring seal, a first controlled gas path, a second controlled gas path, a first returning-gas channel, a second returning-gas channel, a first return-gas opening, a second return-gas opening, a first control valve, and a second control valve, wherein said liquid-dispensing valve is disposed in said housing, wherein said liquid-dispensing valve is connected to said tank, wherein an outlet opening opens at an underside of said filling element, wherein said ring seal is disposed around said outlet opening to form a container-contact surface against which a container's opening is sealed during pressure-filling thereof, wherein said first controlled gas path connects to said first ring channel, wherein said second controlled gas path comprises said first return-gas channel and said second return-gas channel, wherein said first return-gas channel opens at said underside through said first return-gas opening, wherein said second return-gas channel opens at said underside through said second return-gas opening, wherein said first control valve is disposed along said first return-gas channel, wherein said second control valve is disposed along said second return-gas channel, and wherein said first control valve is controlled independently of said second control valve.

13. The apparatus of claim 12, further comprising a centering cone, wherein said centering cone comprises said ring seal.

14. The apparatus of claim 12, further comprising a second ring channel, wherein said first and second return-gas channels open into said second ring channel, wherein said second ring channel is common to all of said filling elements.

15. The apparatus of claim 12, wherein said first return-gas opening and said second return-gas opening are disposed on a circle centered at a filling-element axis of said filling element, and wherein said first return-gas opening and second return-gas opening are diametrically opposed to each other on said circle.

16. The apparatus of claim 12, wherein said first return-gas opening and said second return-gas opening are at a first distance from a filling-element axis of said filing element, wherein said ring seal has a diameter, and wherein said distance is half of said diameter.

17. The apparatus of claim 12, wherein said first controlled gas path comprises a controllable choke arrangement, wherein said controllable choke arrangement is controllable to transition between a first choke-state and a second choke-state, wherein, in said first choke-state, said choke arrangement chokes gas flow, and wherein, in said second choke-state, said choke arrangement permits free flow of gas.

18. The apparatus of claim 17, further comprising a third control valve, wherein said choke arrangement comprises a choke having a fixed flow cross-section and said third control valve, wherein said third control valve is connected in parallel with said choke.

19. The apparatus of claim 17, wherein said choke arrangement comprises a choke having a fixed flow cross-section and a non-return valve arranged parallel to said choke, wherein said non-return valve blocks all flow except for flow into said first ring channel.

20. The apparatus of claim 17, wherein said choke arrangement comprises a controllable choke having a changeable cross-section.

21. The apparatus of claim 12, wherein said liquid-dispensing valve comprises a valve tappet having a gas channel therein, wherein said valve tappet moves axially as said liquid-dispensing valve is opened and closed, wherein said valve tappet comprises a first end and a second end, said second end being further from said outlet opening than said first end, wherein, at said second end, said gas channel within said valve tappet defines a choke opening that opens into a gas chamber, wherein said choke arrangement comprises a choke body disposed in said choke opening, wherein a position of said choke body relative to said choke opening defines a flow cross section of said controllable choke arrangement, wherein axial movement of said valve tappet controls said position of said choke body relative to said choke opening, thereby causing a transition between said first choke-state and said second choke-state.

22. The apparatus of claim 12, further comprising a third control valve, wherein said first gas path further comprises said third control valve, wherein said third control valve is in series with said controllable choke arrangement for opening and closing said first gas path, wherein said third control valve is configured to open during purging, pre-loading, and pressure filling of containers, and wherein said third control valve is configured to close when loading or removing containers from said first filling element.

* * * * *